US005224427A

United States Patent [19]

Riches et al.

[11] Patent Number: 5,224,427

[45] Date of Patent: Jul. 6, 1993

[54] FALL-ARREST SYSTEMS WITH YIELDING MOUNTING BRACKET FOR INSPECTION PURPOSES

[75] Inventors: David Riches, Bangor; Leonard J. Feathers, Ty Croes, both of United Kingdom

[73] Assignee: Barrow Hepburn Sala Ltd., Avon, England

[21] Appl. No.: 807,873

[22] PCT Filed: May 21, 1991

[86] PCT No.: PCT/GB91/00798

§ 371 Date: Feb. 13, 1992

§ 102(e) Date: Feb. 13, 1992

[87] PCT Pub. No.: WO91/17795

PCT Pub. Date: Nov. 28, 1991

[30] Foreign Application Priority Data

May 22, 1990 [GB] United Kingdom ..... 9011370

[51] Int. Cl.[5] ..... E01B 25/18

[52] U.S. Cl. ..... 104/115; 248/548; 182/3; 188/371

[58] Field of Search ..... 104/112, 115, 116; 248/548; 182/3, 5; 188/371, 373, 376, 377

[56] References Cited

U.S. PATENT DOCUMENTS

| | | | |
|---|---|---|---|
| 1,409,702 | 3/1922 | Gill | 182/3 |
| 2,724,463 | 11/1955 | Becker | 188/377 X |
| 3,601,862 | 8/1971 | Hargadon | 248/548 X |
| 4,790,410 | 12/1988 | Sharp et al. | 182/3 X |
| 4,791,243 | 12/1988 | Ibanez et al. | 248/548 X |
| 4,932,626 | 6/1990 | Guillot | 248/548 |

FOREIGN PATENT DOCUMENTS

| | | | |
|---|---|---|---|
| 2136915 | 9/1984 | United Kingdom | 188/371 |

*Primary Examiner*—Robert J. Oberleitner
*Assistant Examiner*—S. Joseph Morano
*Attorney, Agent, or Firm*—Dennison, Meserole, Pollack & Scheiner

[57] ABSTRACT

A personnel fall-arrest system including a flexible safety track (1) which is anchored in spaced relation to a fixture (2) by track anchors (4), and a coupling component (7) for connecting a worker's safety harness to the track via a safety line (8), the component (7) being freely displaceable along the track. Each of the track anchors (4) is formed so that it becomes permanently deformed if subjected to heavy loading due to a fall, thereby signalling that the system requires to be checked and recertified before further use.

5 Claims, 6 Drawing Sheets

FALL-ARREST SYSTEMS WITH YIELDING MOUNTING BRACKET FOR INSPECTION PURPOSES

This invention relates to a personnel fall-arrest system comprising a flexible safety track which is anchored in spaced relation to a fixture by track anchors located at intervals along the track, and a coupling component for connecting a worker's safety harness to said track via a safety line, said component being coupled to said track but being freely displaceable therealong.

The flexible safety track of a system of the kind to which the invention relates can most suitably be a metal cable which is threaded through track-receiving eyes or sleeves provided on the track anchors. Such anchors and the coupling component can be formed so that displacement of the coupling component along the track is not obstructed by the anchors (see e.g. United Kingdom Patent No 2 199 880).

Such systems serve to protect workers in situations where they would otherwise be exposed to risk of serious injury or death by falling. For example, they can be used for protecting workers on walkways running along the exteriors of structures, high above the ground, or on walkways above open vats or other containers holding harmful liquids. Shock-absorbing means is normally incorporated in or associated with such systems for avoiding such abrupt arrest of a fall as could itself cause serious injury.

Each of the components of a personnel fall-arrest safety system should be capable, with a wide margin of safety, of sustaining the forces which may be imposed on it in the event of the fall of a person connected to the coupling component. The track anchors must of course hold to the fixture. And they must also resist separation of the track from the anchors under the applied load.

Any personnel fall-arrest system should be systematically examined periodically in order to check that its components have not become damaged and are in serviceable condition. In the event that a fall takes place, it is important that the system be thoroughly checked and that any damaged parts be replaced before the system is again put to use. Such examinations are very demanding tasks, particularly in the case of systems of considerable length and systems in which important components are not conveniently placed for close inspection. The examinations have to be carried out in situ, where there is an inherent risk of personal accident. The work should be carried out by trained inspectors but despite every care there is always the possibility of a defect being overlooked.

The present invention provides a system wherein there is means which reduces the risk that impairment of the system, caused by heavy loading due to a fall, may be overlooked.

According to the present invention, there is provided a personnel fall-arrest system comprising a flexible safety track which is anchored in spaced relation to a fixture by track anchors located at intervals along the track, and a coupling component for connecting a worker's safety harness to said track via a safety line, said component being coupled to said track but being freely displaceable therealong, characterised in that each of the anchors has an ultimate tensile strength more than sufficient to prevent release of the track under the greatest load liable to be imposed on said anchor due to the fall of a person using the system, but is constructed so that under a load substantially smaller than that maximum it will undergo a permanent deformation which is apparent to the eye.

The invention departs from the common perception that the safety track anchors in this kind of system should be robust enough to sustain a full range of fall-arrest loads without damage. Anchors of a system according to the invention are intentionally liable to be damaged if a person using the system falls and the fall subjects the anchors to forces above a certain magnitude. Because of the adequacy of the ultimate strength of the anchors, this liability of the anchors to become damaged does not make the system unsafe. And the anchor damage, if it occurs, serves the valuable purpose of making it obvious that the system has been subjected to heavy stress and that repair work must be done before the system can be certified for re-use.

Generally speaking, a large proportion of the load imposed on arrest of a person during free fall will be transmitted from the safety track to the fixture via the track anchors nearest the position where the fall takes place. The occurrence of anchor damage in a system according to the invention can therefore make it apparent not only that the system has been subjected to heavy loading due to a fall but also at which region along the system the fall took place. If a worker falls and hangs, suspended from the safety track, immediate rescue of the worker takes precedence over other considerations. With a system as used prior to the present invention, even if steps are taken, following a fall, to warn against further use of the system until it has been re-certified as in good order, it is possible for the system to be left, after the rescue operation, without any record of the actual place along the system where the fall occurred. Knowledge of where the system has been most heavily loaded does not relieve an inspectorate of responsibility for checking the entire system but it does ensure that the most heavily stressed part of the system will receive particuarly careful attention.

The occurrence of an obvious plastic deformation of an anchor under a given load can be ensured by appropriate choice of the material used in the construction of the anchor and of its form and dimensions.

As explained above, anchor damage in a system according to the invention serves as an inspectorate alert signal. The resistance of the track anchors to change of physical form under load determines the response threshold or "sensitivity" of the signal.

The resistance to deformation which the anchors of any given system should have, depends in part on the maximum load to which they may be subjected in the event of the fall of a person using the system. That maximum load depends of course on the specifications of the fall-arrest system as a whole, including whatever shock-absorbing properties it may have. The said resistance must be low enough to ensure that any individual anchor will yield, by deformation, under a load substantially smaller than that maximum. The said resistance also depends on the required signal sensitivity. It is not necessary and generally speaking it is not practical for the deformation resistance of the anchors to be so low that an anchor will become deformed by any load, however small, imposed in consequence of a fall, or a stumble, of a person using the system. It will normally suffice for the response threshold to be such that permanent deformation only occurs if the system is subjected to loading forces which would otherwise entail a real risk of some part or parts of the system sustaining damage without inducing any obvious warning sign that such damage may have occurred.

It is preferable for individual anchors to undergo readily perceivable permanent deformation when subjected to a load of 5 KN or less in a Yield Test as follows:

Yield Test

The anchor to be tested is secured to a fixture in the same way as it would be if it were used as intended in an actual fall-arrest system. A traction force is applied to the track-receiving portion of the anchor by a traction machine working at an extension rate of 0.5 inches (1.27 cm) per minute. The direction in which that force is applied in relation to the orientation of the anchor is such as to simulate the action of a force exerted vertically downwardly on that portion of the anchor when the anchor is in its intended anchored orientation in an actual fall-arrest system. The distance, measured in the direction in which the force is applied, by which the said track-receiving portion of the anchor is displaced from its original position in consequence of the application of a given force, as indicated on the machine gauge, is a measure of the extent of deformation which the anchor undergoes under that force.

A yield resistance of 5 KN as measured by the foregoing Yield Test is not an absolute maximum. It is put forward as a practical upper limit. The safety track anchors can have a yield resistance of that relatively high value in the case of a system in which the anchors are likely to be subjected to loading forces substantially in excess of 5 KN in the event of the arrest of a free fall. In general however it preferable for the safety track anchors of any system according to the invention to have a yield resistance below that value.

In preferred embodiments of the invention, the yield resistance of individual anchors in the system, as determined by the foregoing Yield Test, is such that the extent of permanent deformation, measured in terms of the specified displacement of the track-receiving portion of the anchor, is at least 2 cm under a force of 3 KN. Observance of this condition is likely to ensure that any deformation of an anchor caused by the imposition of fall-arrest forces on the system in the vicinity of an anchor will be very obvious.

In certain embodiments of the invention, each anchor is constructed so that in a Yield Test as hereinbefore specified, it will undergo apparent permanent deformation under a traction force which is less than 60% of the maximum load to which the anchor is liable to be subjected (due to a fall) during use of the system in which the anchor is incorporated. It is also recommended that each anchor be constructed so that in a said Yield Test it undergoes a said apparent permanent deformation under a traction force in the range of 2.5 to 4.5% of the ultimate tensile strength of the anchor.

The occurrence of permanent plastic deformation of an anchor implies that the anchor has also contributed to shock-absorption. That is a further advantage of a system incorporating anchors which yield in that manner.

It is recommended to use anchors each of which is constructed so that material of the anchor between the fixture and the safety track forms one or more loops or coils. The adoption of such a looped or coiled geometric form facilitates realisation of a high ultimate tensile strength in combination with a relatively low resistance to permanent plastic deformation.

A particularly advantageous form of anchor is one comprising (i) a bracket having a head portion which surrounds and locates the safety track, a body portion formed by a loop of material between that head portion and the fixture, and a neck portion joining said head and body portions; and (ii) fastening means securing the body portion of the bracket to the fixture. Such a bracket can advantageously be constructed so that if it is subjected to progressively increasing traction in a Yield Test as hereinbefore described, the bracket becomes deformed, before rupture thereof, into a condition in which the material which previously formed the head, neck and body portions of the bracket form parts of a single loop. It is particularly beneficial for the said material between the fixture and the safety track to form a polygonal loop by which the anchor is secured to the fixture, and a neck portion projecting from one corner of the polygon. Such a geometric form can confer very desirable performance properties on the anchor. The head, neck and body portions of the bracket are preferably integral parts of a single strip of material which has been folded about transverse axes to define those bracket portions and so that two portions of the strip lie face to face to form a two-ply bracket wall in the region where the bracket body is secured against the fixture by the fastening means.

Each of the safety track anchors preferably comprises an anchor bracket and a single fastener about which the bracket will bodily pivot if a sufficiently large turning moment is imposed on it in consequence of heavy loading of the track at a position on one side of the anchor. If a portion of the safety track between two anchors is pulled downwardly and subjected to heavy loading as a result of a fall, the forces transmitted to those two anchors can cause the two brackets to pivot about their fasteners so that the forces on the head portions of the brackets and the stresses on the contacting portions of the safety track are better distributed.

Certain embodiments of the invention, selected by way of example, will now be described with reference to the accompanying drawings in which.

Figure 8:
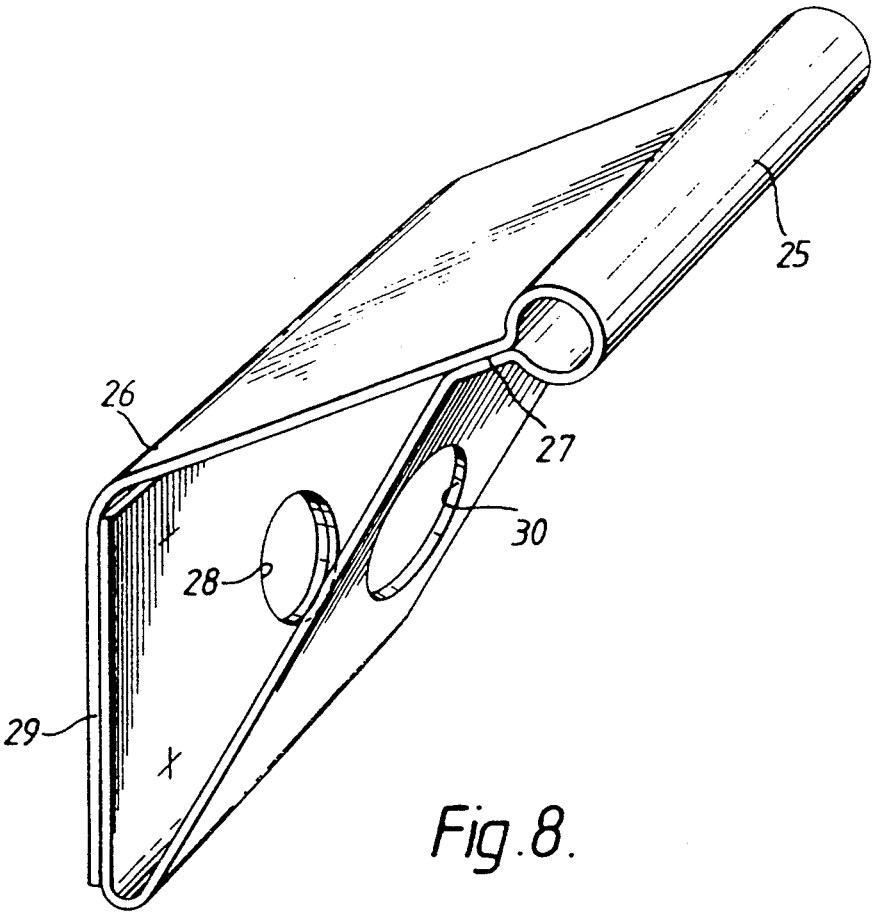
Figure 9:
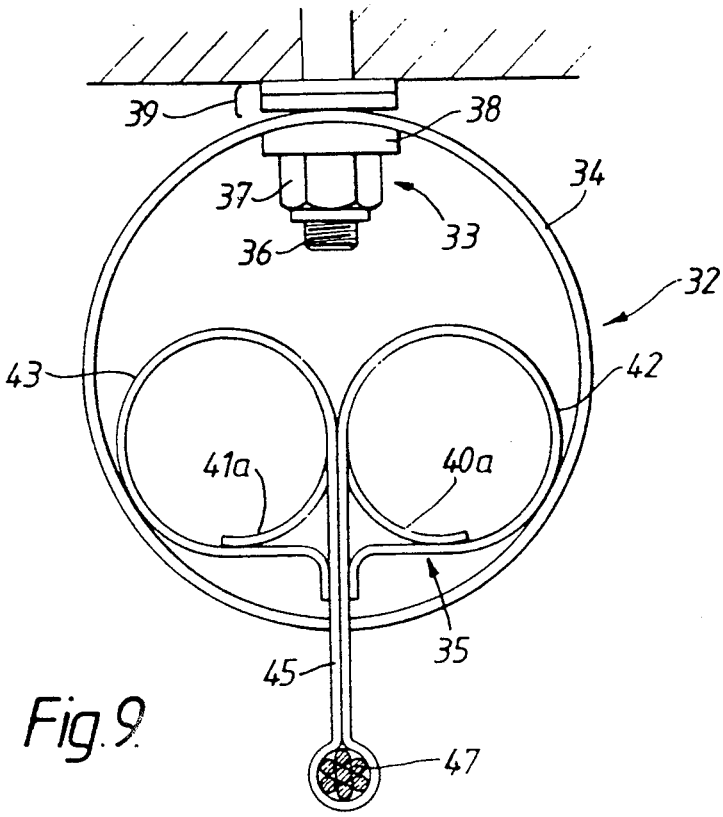
Figure 10:
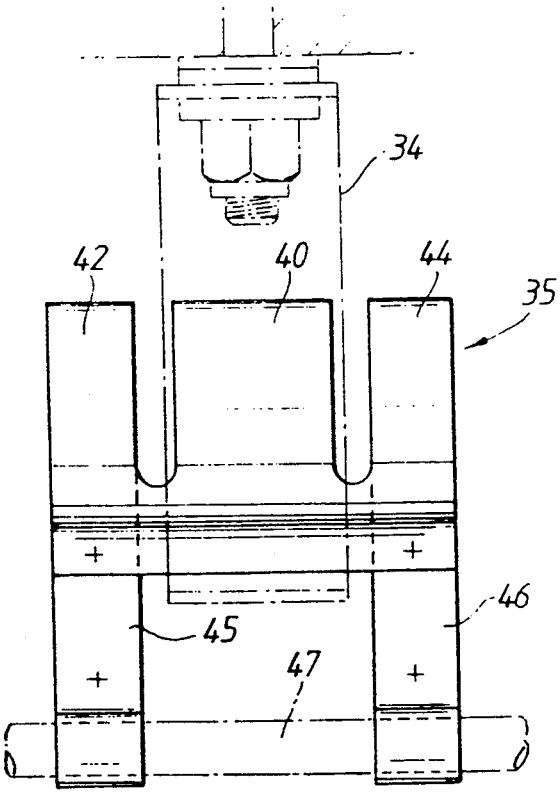
Figure 11:
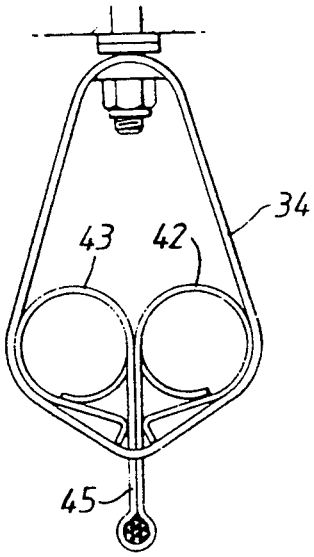
Figure 12:
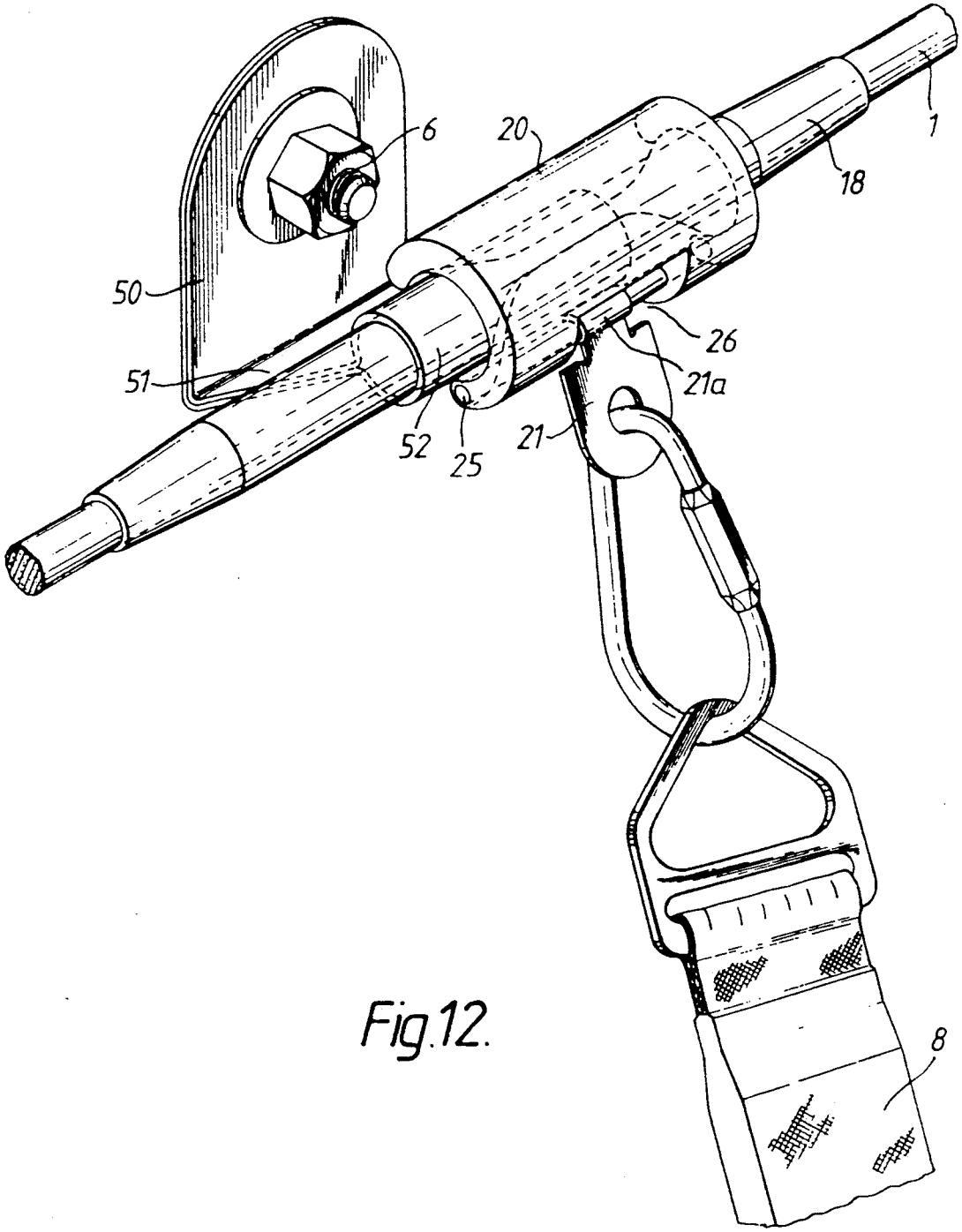

FIGS. *7a* and *7b* shows stages in the deformation of such a bracket under load;

FIG. 8 shows an alternative form of anchor bracket;

FIG. 9 is an end elevation of another form of safety track anchor;

FIG. 10 is a front elevation of a part of that anchor;

FIG. 11 shows an anchor as represented in FIGS. 9 and 10 at a stage during its progressive deformation under load; and FIG. 12 is a perspective view of part of a system according to the invention in which the track anchors incorporate brackets of a more simple form.

Figure 1:
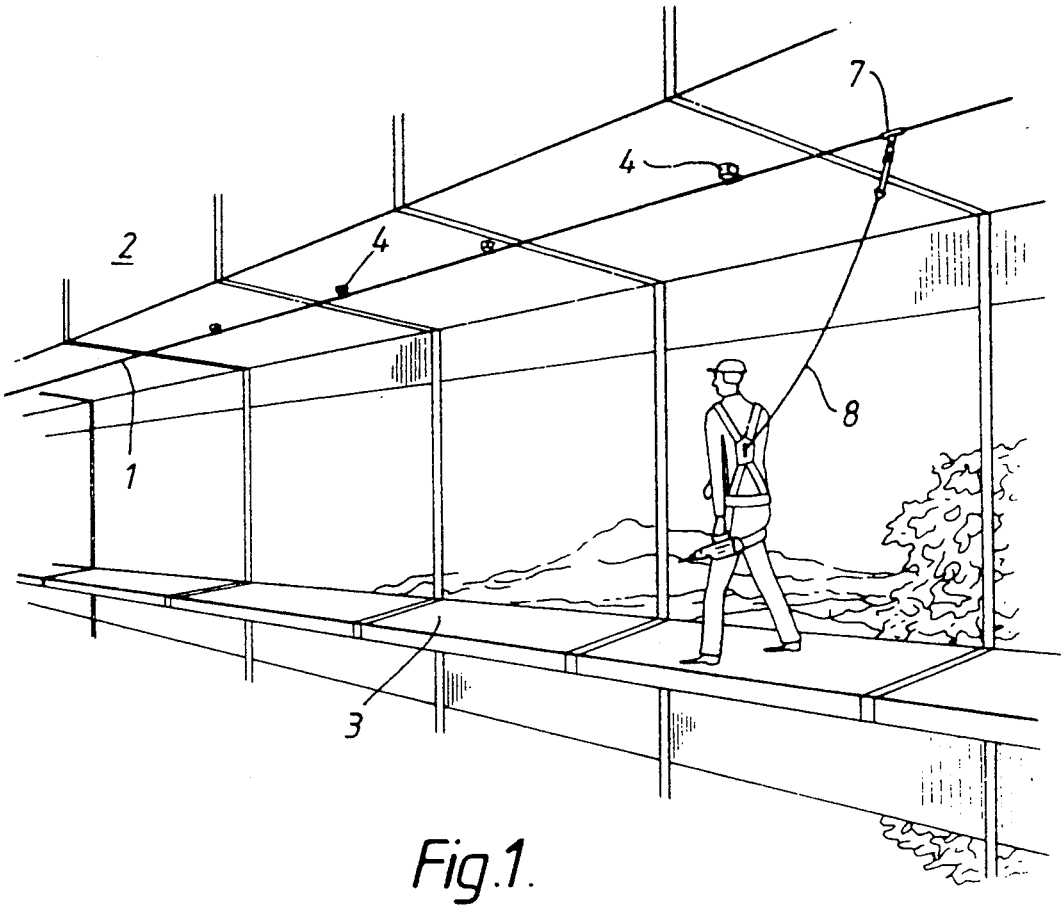
FIG. 1 shows part of a personnel fall-arrest system according to the invention.
Figure 2:
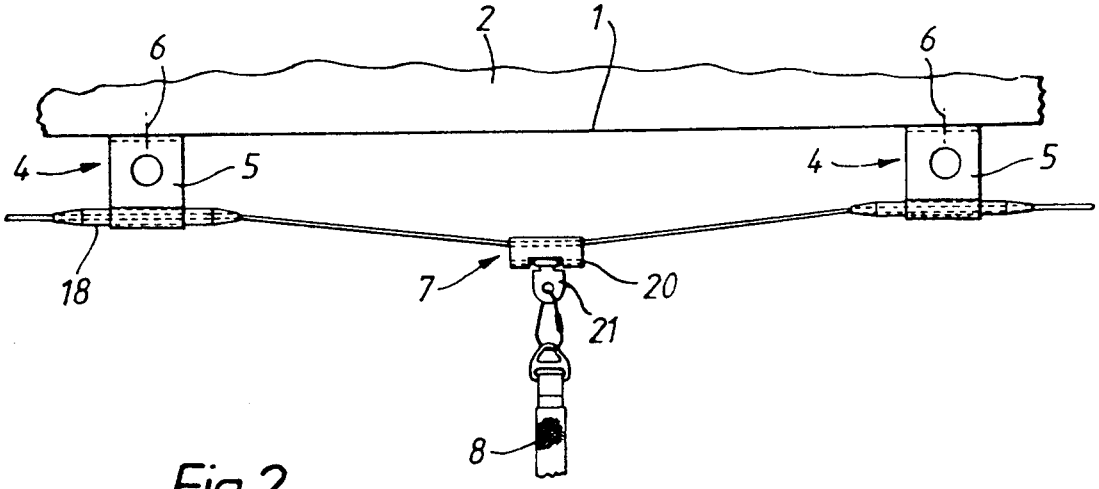
FIG. 2 shows a part of the system at the moment of a fall-arrest.

In the fall-arrest system represented in FIGS. 1 and 2, a safety track in the form of a wire cable 1 is anchored to the underside of a structure 2 overhanging a worker's walkway 3. The cable can follow an endless course around the structure or it may extend between stations at which the ends of the cable are secured to the fixture via suitable end fittings on the cable. Cable anchors 4 located at intervals along the length the cable serve to support the cable and anchor it to the structure 2. Each of the anchors 4 comprises a cable-supporting and locating bracket 5 and a fastening bolt 6 which secures the bracket to the fixture 2.

A coupling component 7 is threaded onto the cable 1 and is freely slidable therealong. A worker's safety harness is connected to that coupling component via a lanyard 8.

Figure 3:
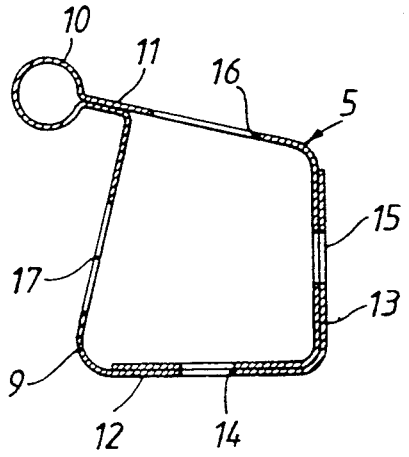
FIG. 3 is a side sectional elevation of part of an anchor bracket used in that system.
Figure 4:
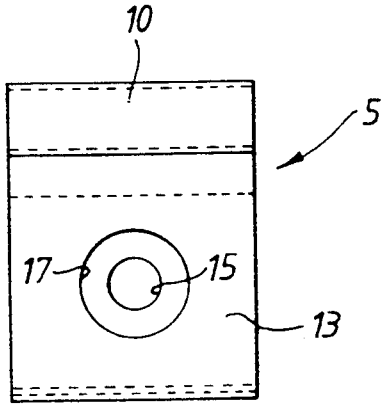
FIG. 4 is a front elevation of that bracket.

The construction of the brackets 5 is shown in FIGS. 3 and 4. Each bracket has a body portion 9 in the form of a quadrilateral loop, a head portion 10 of tubular form and a neck 11 joining the head and body portions. The bracket is formed from a single strip of metal by bending the strip about transverse axes. Opposed end portions of the strip overlap to give two sides 12, 13 of the quadrilateral body portion of thickness twice that of the strip. The overlapping end portions of the strip are spot-welded together in each of the sides 12, 13. Holes 14, 15 are formed in the body sides 12, 13 respectively for the reception and location of a fastening bolt 6 (FIG. 2). When the anchor is installed, the bracket is secured to the fixture by only one bolt. The bracket can be orientated with either body side 12 or body side 13 against the fixture and it is for that reason that each of those sides is formed with a hole for an anchor bolt. Larger holes 16, 17 are formed in the body sides opposite sides 12 and 13 to allow access of a tool to the head of the bolt.

Figure 5:
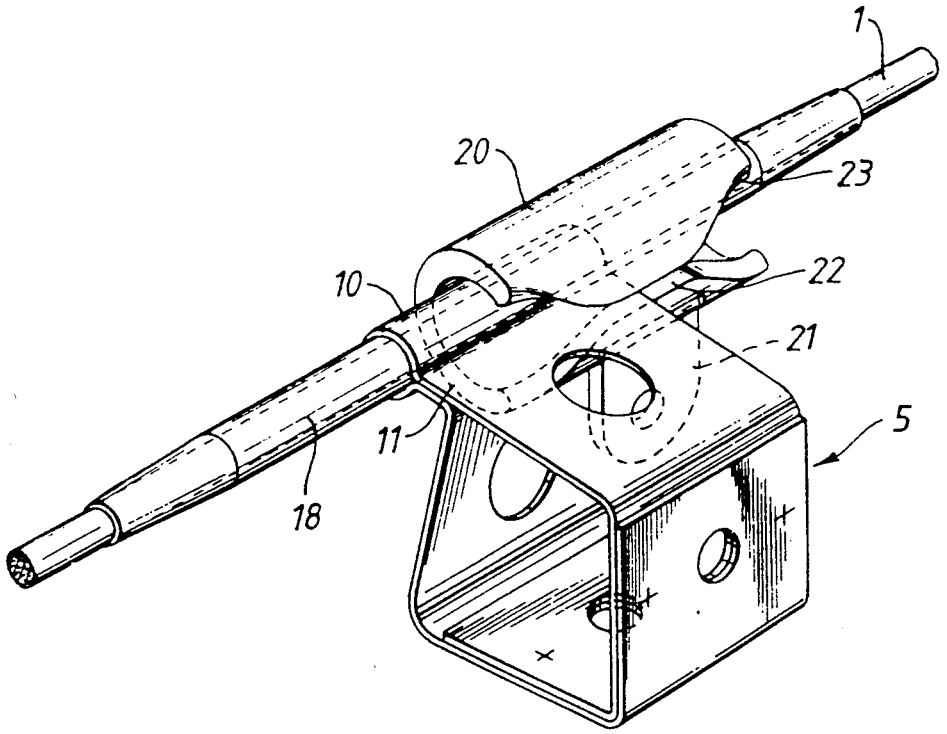
FIG. 5 is a perspective view of that bracket and cooperating parts of the system.

In the installed system, the cable 1 passes through the tubular head portions 10 of the anchor brackets 5. The cable can slide axially within the head portion of each bracket. It is beneficial to fit the tubular head portion of each bracket, as shown in FIGS. 2 and 5, with a flexible extension tube 18 which projects from each side of such head portion. It is very suitable for such extension tube to be of synthetic polymeric material, e.g. nylon. The extension tubes afford relatively low frictional restraint to sliding movement of the cable 1 and if a part of the cable between two anchor brackets is pulled downwardly by fall-arrest forces as indicated in FIG. 2, the extension tubes of those brackets serve to avoid high stress concentration on the cable due to localised bearing contact with the metal head portions.

The following is a description of the construction of the coupling component 7 as shown in FIGS. 2, 5 and 12. The component comprises a longitudinally slotted tube 20. A link 21 for connection to the worker's lanyard 8 as shown in FIGS. 1 and 2 is pivotally connected to the wall of that tube. The bore of the tube 20 is larger than the external diameter of the track-receiving tubular head portions 10 of the anchor brackets so that the slotted tube can slide over those bracket head portions. The longitudinal slot 22 has over a central portion of its length a width which is substantially smaller than the diameter of the cable 1 but is a little greater than the thickness of the neck portions 11 of the anchor brackets. The opposed end portions of the slot 22 are flared so that the mouth of the slot at each end of the tube is relatively wide. The flared portions provide cam faces or edges 23. The link 21 has a sleeve portion 21*a* (FIG. 12) which is traversed by a pivot pin 25. This pivot pin bridges an opening 26 in the wall of the tube 20. The end portions of the pin are secured in receptive holes formed in that tube wall. The diameter of the pivot pin is such that it passes through the sleeve portion 21*a* of the link with clearance, so that the link is very freely pivotable relative to the slotted tube. The pivot pin 25 is angularly spaced by 90° (around the axis of the slotted tube) from the longitudinal centre line of the slot 22.

As a worker moves along the walkway 3 (FIG. 1), the coupling component is drawn along the cable 1 by the pulling force on the lanyard 8. When the slotted tube reaches one of the cable anchors, first the anchor bracket extension tube 18 and then the bracket head portion 10 enters the bore of the slotted tube. The neck portion 11 of the bracket enters the slot 22. The coupling component therefore advances smoothly past the bracket. If the angular orientation of the slotted tube around the cable 1, at the time that tube arrives at the bracket, is not such that the central narrow portion of the slot 22 is in alignment with the neck 11 of the bracket, that neck will abut against one or another of the said cam faces or edges 23 and thereby cause the tube 20 to turn so that the coupling component continues its movement past the bracket without any impedance.

Figure 6:
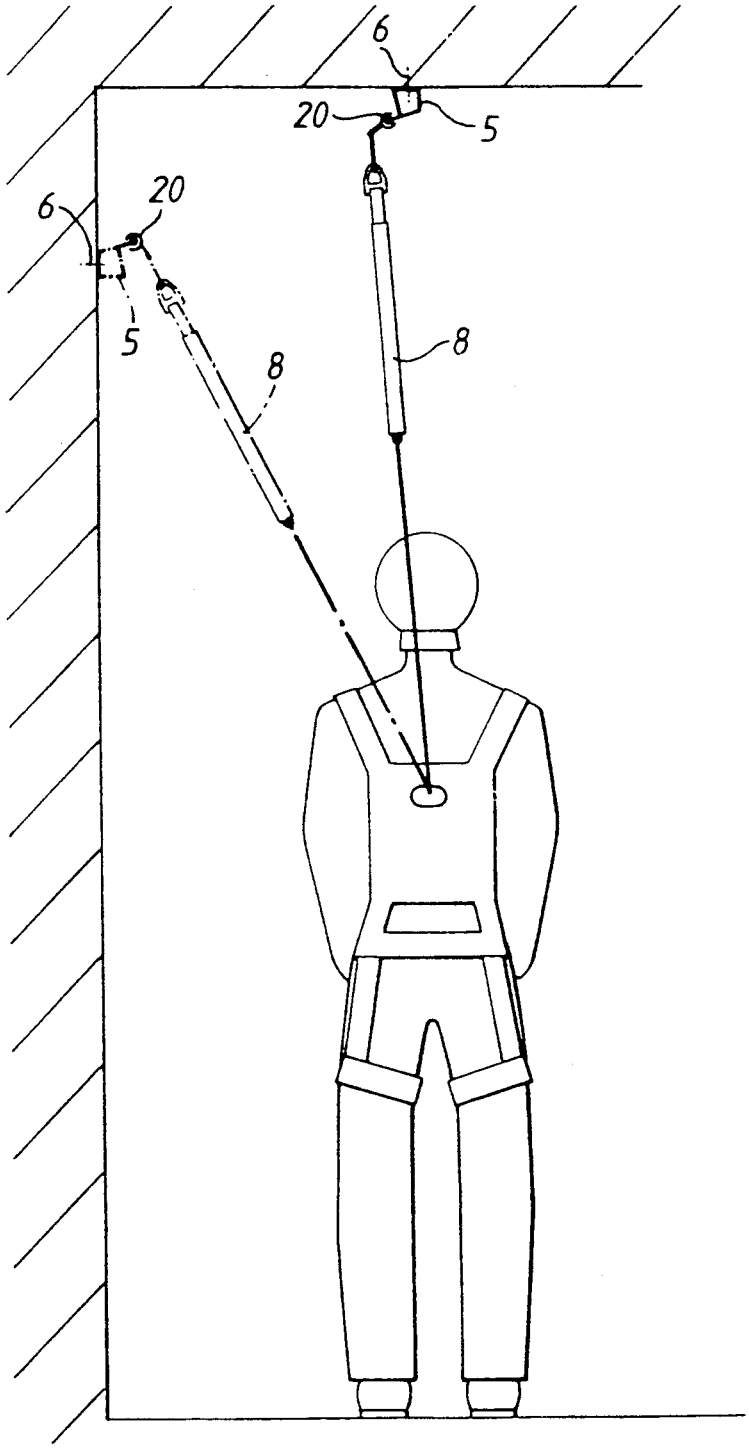
FIG. 6 shows alternative fixing positions of such a bracket in relation to a walkway.
Figure 7A:
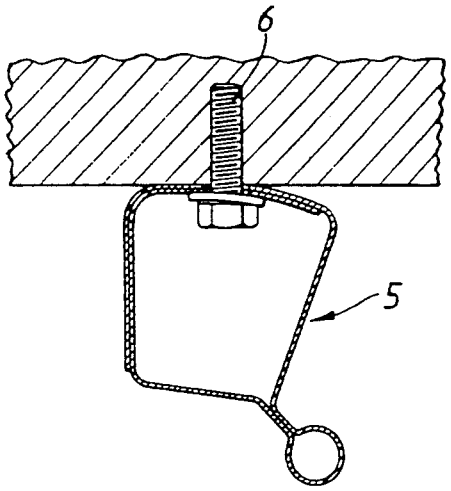
Figure 7B:
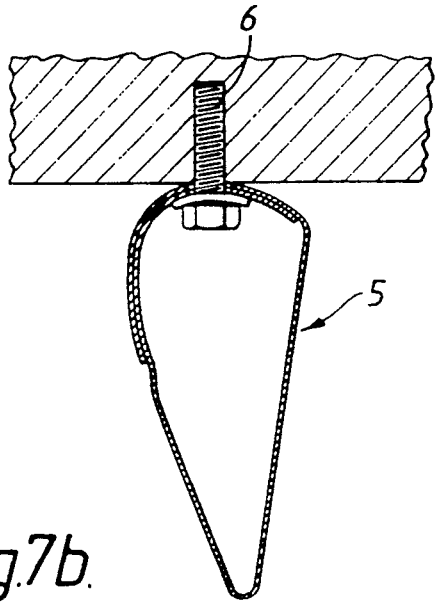

FIG. 6 shows in full line the way in which anchor brackets of the form shown in FIGS. 2–5 are orientated in relation to the overhead fixture in the system depicted in FIG. 1. FIG. 6 shows in broken line a way in which the brackets can be arranged for anchoring a safety track to a vertical surface. When the coupling component 7 is being drawn along the cable 1 by a pulling force on the worker's lanyard 8, the angular orientation of the slotted tube 20 around the cable will be such that the slot 22 is disposed to one side of the cable. The slot must be to the same side of the cable as the neck portions 11 of the brackets. Provided that condition is satisfied, the coupling component will travel smoothly past the brackets as previously described. As is apparent from FIG. 6, that condition is satisfied in both of the illustrated bracket mounting positions. For suiting the anchor bracket position shown in broken line, in which the neck portion of the bracket is on the left hand side of the cable in the aspect of the drawing, the coupling component 7 is fitted on the cable, at the time when the system is installed, in an orientation which is the end-for-end reversal of that which suits the bracket position shown in full line.

Safety apparatus incorporating a coupling component of the form shown in FIGS. 2, 5 and 12 is described and claimed in International Patent Application PCT/GB92/00916 in which the United States of America is a designated state.

Anchor brackets as described with reference to FIGS. 3 and 4 were individually subjected to the Yield Test as hereinbefore set out. Each bracket was formed from a 16 SWG strip of austenitic stainless steel. The strip had a width of 60 mm. Each bracket had the following dimensions (referring to FIG. 3):

| | |
|---|---|
| Vertical height from the centre of the head portion 10 to the base 12: | 67 mm |
| Horizontal distance from a vertical plane through the centre of the head portion to the outer face of side 13: | 67 mm |
| Height of side 13: | 54 mm |
| Overall length (measured in the plane of the drawing) of the base 12: | 60 mm |
| External diameter of the head portion: | 18 mm |
| Diameter of apertures 14,15 | 13 mm |

-continued

| | |
|---|---|
| Diameter of apertures 16,17: | 30 mm |

In a first test one of the brackets was secured to a fixture with side 12 (FIG. 3) of the bracket against the fixture in the same way as the bracket shown in full line in FIG. 6. A rigid bar was inserted through the head portion 10 of the bracket and traction force was exerted on the bracket by the traction machine via that bar. The traction force was exerted in a direction normal to the fixture surface against which the bracket was secured. Substantial plastic deformation of the bracket occurred before the traction force reached 2 KN. FIG. *7a* represents the shape into which the bracket had become permanently deformed by the traction force when it reached 2.5 KN. At that stage the displacement of the head portion of the bracket from its original position (measured parallel with the direction of the tractive force) had reached 2 cm. The traction force was further increased, at the same rate, to determine the ultimate tensile strength of the bracket. That ultimate tensile strength was found to be 49.24 KN. At that loading the metal strip fractured at the location of the anchor bolt. Before breakage, the entire metal strip had become deformed into a single loop as depicted in FIG. *7b*.

In a further test, an identical bracket was secured to a fixture with side 13 (FIG. 3) of the bracket against the fixture in the same way as the bracket shown in broken line in FIG. 6. The test was carried out in the same manner as the previous one except that in this case the traction force was exerted parallel with side 13 of the bracket and in a direction towards the plane of side 12 thereof. In this test also, substantial permanent plastic deformation of the bracket occurred before the traction force reached 2 KN. At the stage the traction forced reached 2.5 KN the head portion of the bracket had become permanently displaced from its original position by a distance (measured parallel with the direction of the traction force) of 4 cm. The ultimate tensile strength of the bracket, determined by continuing to increase the traction force at the same rate, was found to be 50.94 KN. At that loading the metal strip factured at the location of the anchor bolt. As in the preceding test, the metal strip became deformed into a single loop before breakage occurred.

The very favourable combination of properties of the bracket: its ultimate strength, yield resistance and deformation characteristics, are contributed to by the polygonal form of the bracket body, the presence of single-ply corner angles at the junctions of single-ply sides 16 and 17 with the double-ply fixing sides 12, 13, and the double-ply construction of the neck 11.

FIG. 8 shows an alternative form of anchor bracket which can be employed in a system according to the invention. The bracket comprises a tubular head portion 25, a body portion 26 in the form of a triangular loop, and a neck portion 27 joining such head and body portions. The bracket can be secured to a surface by an anchor bolt fitted through hole 28 in side 29 of the body portion of the bracket. A hole 30 of larger diameter is provided in the opposite wall of the body portion to allow access of a tool to the anchor bolt head. The bracket has been formed from a single strip of metal. End portions of the strip overlap and are spot-welded together to provide a double thickness of material where the anchor bolt will be located. It is a straightforward matter to select the bracket material and dimensions so that the bracket combines a requisite high ultimate tensile strength with a relatively low resistance to permanent deformation under load in accordance with the requirements of the invention.

Reference is now made to FIGS. 9 and 10 which show a safety track anchor comprising a bracket 32 which incorporates coils, and a fastener 33. The bracket comprises two components: a body component formed by a metal ring 34, and a coiled track-supporting component 35. In FIG. 10 the ring 34 has been indicated merely in broken outline so that parts of the component 35 which lie within that ring can be seen.

The ring 34 is secured to a fixture by a fastener comprising a threaded metal stud or bolt 36 which extends through a hole in the wall of the ring, a nut 37, and washers 38–39.

The coiled track-supporting component 35, which has been formed by bending a strip metal blank, comprises two coils 40 located back-to-back, centrally of the width of the blank. One of those coils is apparent in FIG. 10. The other one lies immediately behind it in the aspect of that figure. The width of those coils (measured transversely of the metal strip) is equal or nearly equal to the width of the metal ring 34. When the track-supporting component 35 and the ring 34 are assembled, the said coils fit inside the ring. The strip portions 40*a* and 41*a* which can be seen in FIG. 9 are end portions of those coils. Abreast of the ends of each of the two coils 40 and co-axial therewith are two loops which in the assembly are located outside the metal tube at opposite ends thereof. The two loops at one end of the component 35 are visible in FIG. 9 and are denoted 42, 43. The loop which is co-axial with loop 42 and located at the opposite end of the component is visible in FIG. 10 and is denoted 44. Portions of the metal strip extend tangentially from the pairs of end loops and form two-ply arms 45, 46 which project radially past the periphery of the ring 34 forming the body component. Each arm terminates at its free end in a tubular head portion or eye through which a flexible safety track member 47 can be threaded. The plies of the arms are spot-welded together and to the ends of the metal strip portions forming the external loops.

Instead of allowing direct contact of the safety track with the metal eyes, these can be made large enough to receive a tubular track guide like the extension tube 18 shown in FIGS. 2 and 5. A single such tube can be provided on each bracket so that the tube bridges the two arms 45, 46.

The track-supporting component 35 is arcuately bodily displaceable about the axis of the ring 34. When a system incorporating two-component brackets of this form is in use, if a pull is exerted on the safety track in a direction which is at an angle to the plane of the arms 45, 46 of the adjacent track-supporting components, those track-supporting components can in response to that pull turn bodily about the axis of the ring 34 so that the arms become aligned with the direction of the pull.

The two-component bracket can be used for anchoring the safety track to an overhead horizontal fixture surface as shown in FIG. 9 or to a vertical fixture surface at any of a number of different levels.

The washer 38 provides a part-cylindrical seating face for the ring 34. If a load of sufficient magnitude is applied to the safety track between two of the anchors, the force will exert on those anchors a turning moment causing the anchor rings to slip on their seating faces into angular positions, so reducing the stress concentration on the safety track.

Brackets of the form represented in FIGS. 9 and 10 can easily be made to achieve the required ultimate strength and yield resistance properties. Brackets of that form, made from 16 SWG austenitic stainless steel and having an ultimate tensile strength (as determined in a Yield Test as hereinbefore described) of about 50 KN were found to have a yield resistance somewhat lower than that of the tested quadrilateral brackets hereinbefore described which were made from the same material and had a similar ultimate tensile strength. During the build up of the traction force the ring 34 of the brackets became deformed into an elongate loop; the spot welds in the track-supporting component 35 ruptured, and the loops and coils of that component contracted with consequent extension of the arms 45 and 46. FIG. 11 represents the form of such a bracket at a stage during the progressive increase of the traction force from 0 to 5 KN.

In the event of the fall of a worker using a safety system incorporating anchor brackets of the forms shown in FIGS. 9 and 10, the permanent deformation of the brackets which would take place under the applied load would make it very apparent to an inspectorate that the system has been subjected to heavy loading due to a fall and would also make it very apparent at what region of the system the fall occurred. The deformation of the brackets would of course also contribute to energy absorption.

FIG. 12 shows part of a system according to the invention which except for the anchor brackets is the same as that described with reference to FIGS. 1 to 5. Parts of the system corresponding with parts of the system according to FIGS. 1 to 5 are denoted by the same reference numerals. Each of the brackets in the system according to FIG. 12 is formed from a metal blank which is bent to form a two-ply base flange 50, a two-ply cantilever arm 51 and a track-receiving eye 52 at the free end of that arm. It is a straightforward matter to select the material and dimensions of an anchor of that form so that it has the required high ultimate tensile strength and a relatively low resistance to permanent plastic deformation as required by the invention.

We claim:

1. A personnel fall-arrest system comprising a flexible safety track (1) held in spaced relation to a fixture (2) by brackets (5) which are located at intervals along the track (1) and are secured to the fixture (2), and a coupling component (7) for connecting a worker's safety harness to said track via a safety line (8), said component (7) being coupled to said track but being freely displaceable therealong, each of the brackets has a head portion (10,25) which surrounds and locates the safety track (1), a body portion (9,26) formed by a loop of material between said head portion and the fixture (2), and a neck portion (11,27) joining said head and body portions; said head (10,25), neck (11,27) and body (9,26) portions of the bracket being integral parts of a single strip of material which has been folded about transverse axes to define those bracket portions and so that two portions of the strip lie face to face to form a two-ply bracket wall (12,13,29) by which the body portion of the bracket is secured to the fixture (2); said bracket having an ultimate tensile strength more than sufficient to prevent release of the track under the maximum load liable to be imposed on said bracket (5) due to the fall of a person using the system but having a resistance to permanent deformation such that a load substantially smaller than that maximum will suffice to cause it to undergo obvious permanent deformation.

2. A system according to claim 1, wherein each of the brackets has a resistance to permanent deformation such that if the bracket is subjected to a Yield Test in which after securing the bracket to a fixture in the same way as it is in the fall-arrest system, a traction force is applied to the head portion of the bracket by means of a traction machine working at an extension rate of 0.5 inches (1.27 cm) per minute so as to subject the bracket to a final traction force of 3 KN in a the direction in which it would be loaded in the event of the fall of a person using the system, that force causes the head portion of the bracket to be displaced from its original position by a distance, measured in the direction in which the force is applied, of at least 2 cm.

3. A personnel fall-arrest system comprising a flexible safety track (1) held in spaced relation to a fixture (2) by bracket (5,32) which are located at intervals along the track (1) and said brackets are secured to the fixture, a coupling component (7) for connecting a worker's safety harness to said safety track via a safety line (8), said coupling component (7) being coupled to said safety track but being freely displaceable therealong, each of the brackets being formed by folding a metal strip so that the bracket has a tubular head portion (10,25,52) which locates and slidably supports the safety track (1) and a body portion (9,26,34) in the form of a loop having a wall portion (12,13,29) which is formed by overlapping end portions of said metal strip and by which the wall portion of the bracket is secured to the fixture, said bracket having an ultimate tensile strength more than sufficient to prevent release of the track under the maximum load liable to be imposed on it in the event of the fall of a person using the system but having a resistance to permanent deformation such that a load substantially smaller than that maximum will suffice to cause it to undergo obvious permanent deformation.

4. A system according to claim 3, wherein each of said brackets (5) has a body portion (9,26) which is in the form of a polygonal loop, and has a neck portion (11,27) which projects from one corner of the polygonal loop and said neck portion joins that body portion to the head portion (10,25) of the bracket.

5. A system according to claim 3, wherein each of the brackets has a resistance to permanent deformation such that if the bracket is subjected to a Yield Test in which after securing the bracket to a fixture in the same way as it is in the fall-arrest system, a traction force is applied to the head portion of the bracket by means of a traction machine working at an extension rate of 0.5 inches (1.27 cm) per minute so as to subject the bracket to a traction force of 3 KN in the direction in which it would be loaded in the event of the fall of a person using the system, that force causes the track-holding portion of the bracket to be displaced from its original position by a distance, measured in the direction in which the force is applied, of at least 2 cm.

* * * * *